US009541363B2

(12) United States Patent
Burky et al.

(10) Patent No.: US 9,541,363 B2
(45) Date of Patent: Jan. 10, 2017

(54) CONTROLLED FRAGMENTATION OF A WARHEAD SHELL

(71) Applicant: Battelle Memorial Institute, Columbus, OH (US)

(72) Inventors: Thomas E. Burky, Mansfield, TX (US); John R. Leach, Hilliard, OH (US)

(73) Assignee: BATTELLE MEMORIAL INSTITUTE, Columbus, OH (US)

( * ) Notice: Subject to any disclaimer, the term of this patent is extended or adjusted under 35 U.S.C. 154(b) by 0 days.

(21) Appl. No.: 14/471,677

(22) Filed: Aug. 28, 2014

(65) Prior Publication Data

US 2016/0054107 A1 Feb. 25, 2016

Related U.S. Application Data

(62) Division of application No. 12/457,950, filed on Jun. 25, 2009, now Pat. No. 9,255,774.
(Continued)

(51) Int. Cl.

| | |
|---|---|
| ***F42B 12/22*** | (2006.01) |
| ***F42B 12/28*** | (2006.01) |
| ***F42B 12/20*** | (2006.01) |
| ***F42B 12/10*** | (2006.01) |
| ***F42C 19/095*** | (2006.01) |
| ***F42C 19/08*** | (2006.01) |

(52) U.S. Cl.
CPC ..... *F42B 12/28* (2013.01); *F42B 12/10* (2013.01); *F42B 12/20* (2013.01); *F42B 12/208* (2013.01); *F42B 12/22* (2013.01); *F42C 19/0842* (2013.01); *F42C 19/095* (2013.01)

(58) Field of Classification Search
CPC . F42C 19/095; F42C 19/0838; F42C 19/0842; F42B 12/10; F42B 12/20; F42B 12/22; F42B 12/207; F42B 12/208; F42B 12/24; F42B 12/28
USPC ..... 102/473, 475, 476, 478, 481, 489, 491,102/492, 493, 494, 495, 496, 497
See application file for complete search history.

(56) References Cited

U.S. PATENT DOCUMENTS 3,703,865 A * 11/1972 Gilbertson ..... F42C 19/095 102/475
3,714,897 A 2/1973 Parker
(Continued)

FOREIGN PATENT DOCUMENTS

DE 004139373 C1 11/1991
DE 4139371 C1 * 12/2000 ..... F42B 12/24
(Continued)

OTHER PUBLICATIONS

English Translation of DE 41 39 371 C1; Translated by FLS, Inc.; Mar. 2016.*

*Primary Examiner* — James S Bergin
(74) *Attorney, Agent, or Firm* — Richard M. Klein; Fay Sharpe LLP

(57) ABSTRACT

A series of small explosive charges are used to preferentially crack the casing of a warhead to provide for a controlled fragmentation of the warhead. During detonation of the warhead's explosive fill, the casing will break early in the process along predetermined lines resulting in very large fragments that are projected toward the ground and away from innocent civilians. A fragmentation control collar which contacts these charges can be fitted on the outside of existing warheads. An annular liner within the warhead aids in the controlled fragmentation.

10 Claims, 11 Drawing Sheets

Related U.S. Application Data

(60) Provisional application No. 61/129,476, filed on Jun. 30, 2008.

(56) References Cited

U.S. PATENT DOCUMENTS

| | | | | | |
|---|---|---|---|---|---|
| 3,796,158 | A | | 3/1974 | Conger | |
| 3,796,159 | A | | 3/1974 | Conger | |
| 3,820,461 | A | | 6/1974 | Silvia | |
| 3,877,376 | A | | 4/1975 | Kupelian | |
| 3,949,674 | A | * | 4/1976 | Talley | F42B 12/60 102/476 |
| 3,960,085 | A | | 6/1976 | Abernathy et al. | |
| 4,026,213 | A | | 5/1977 | Kempton | |
| 4,106,410 | A | | 8/1978 | Borcher et al. | |
| 4,147,108 | A | | 4/1979 | Gore et al. | |
| 4,516,501 | A | * | 5/1985 | Held | F42B 12/22 102/275.5 |
| 4,655,139 | A | | 4/1987 | Wilhelm | |
| 4,745,864 | A | * | 5/1988 | Craddock | F42B 12/22 102/491 |
| 4,955,939 | A | | 9/1990 | Petrousky et al. | |
| 5,050,503 | A | | 9/1991 | Menz et al. | |
| 5,131,329 | A | * | 7/1992 | Lips | F42B 12/44 102/364 |
| 5,182,418 | A | | 1/1993 | Talley | |
| 5,450,794 | A | | 9/1995 | Drimmer | |
| 5,544,589 | A | | 8/1996 | Held | |
| 6,135,028 | A | | 10/2000 | Kuhns et al. | |
| 6,484,642 | B1 | | 11/2002 | Kuhns et al. | |
| 6,966,265 | B2 | * | 11/2005 | Ronn | F42B 12/32 102/389 |
| 6,973,878 | B2 | | 12/2005 | Lloyd et al. | |
| 7,017,496 | B2 | | 3/2006 | Lloyd | |
| 7,127,995 | B2 | | 10/2006 | Ronn et al. | |
| 7,743,707 | B1 | | 6/2010 | Melin et al. | |
| 8,091,482 | B2 | | 1/2012 | Rotkopf | |
| 8,161,884 | B1 | | 4/2012 | Kokodis et al. | |
| 2002/0020323 | A1 | | 2/2002 | Dassis | |
| 2007/0084376 | A1 | | 4/2007 | Lloyd | |

FOREIGN PATENT DOCUMENTS

| | | | | | |
|---|---|---|---|---|---|
| DE | 102005031588 | B3 | | 7/2005 | |
| DE | GB 2442382 | A | * | 4/2008 | F42B 12/208 |
| FR | GB 2460290 | A | * | 12/2009 | F42B 12/22 |

* cited by examiner

CONTROLLED FRAGMENTATION OF A WARHEAD SHELL

CROSS-REFERENCE TO RELATED APPLICATIONS

This application is a divisional of U.S. patent application Ser. No. 12/457,950, filed Jun. 25, 2009, now U.S. Pat. No. 9,255,774, which claimed priority to U.S. Provisional Patent Application Ser. No. 61/129,476, filed Jun. 30, 2008.

BACKGROUND OF THE DISCLOSURE

Standard explosives, and applications of explosives such as warheads and mining boreholes, are designed to perform a specific task by detonating. Detonation is defined as a supersonic reaction rate which is propagated as a shock through the explosive material. In the case of an explosive warhead, detonation of the explosive is designed to produce a set of lethal effects such as fragmentation of the warhead casing, thermal effects from the heat of detonation and blast effects from the shock that is generated by the detonation.

More specifically, when detonation is initiated in one end of a warhead, typically a cylindrical explosive charge, the detonation travels through the explosive at speeds of over 20,000 feet per second. The detonation results in both a very rapid generation of gas from the explosive and the transfer of momentum to the warhead casing material, which may be made of, for example, steel. The steel casing is rapidly expanded and breaks up into small pieces due to the action of the rapid pressurization and momentum transfer. A steel case will break up into long strips initially and the strips will then break up into short high velocity fragments. Standard warhead is normally initiated at a single point on one end along the axis of the warhead. The detonation propagates down the length of warhead producing roughly equal fragment sizes and energy in all directions perpendicular to the axis of the warhead, albeit with small induced "Taylor" angle in the direction of detonation propagation.

Sometimes the destructive effects from a given warhead design are more lethal than is actually required for a specific target situation. However, it is not feasible to design a warhead for each and every situation on the battlefield, nor is it logistically possible to provide such an array of warheads where they are needed during battle. In many cases it may be impossible to complete a bombing mission with a large bomb that is readily available due to the likelihood of unintended damage, while a smaller bomb is not available at the time. This either limits that use of high value assets such as bomber aircraft or may endanger friendly ground forces from collateral damage. Additionally, more and more wars are being fought in urban areas, as terrorist and guerilla forces locate their headquarters and forces in the midst of civilian populations. Therefore, there is a need for the ability to tune the output of a given warhead design so that it can address multiple situations that occur during battle.

It has been shown that bombs and warheads can be made to have tunable destructive effects by first initiating a deflagration or combustion in the high explosive and then initiating a detonation from an opposite end of the high explosive.

A different and perhaps more useful approach to controlling lethal effects from an explosive warhead is to utilize a carefully designed pattern of detonators within and outside of the casing of the warhead. It has been known for many years that the fragmentation energy from a warhead may be enhanced in a given direction by changing the initiation pattern in the warhead. The initial application for this technology appears to have been for air-to-air missile warheads, where a near-miss was a common occurrence and warhead directionality was thought to be vital to maintaining lethality.

It is most advantageous to have a directed limited concentrated fragmented charge, which provides for a powerful charge in a limited area, thus avoiding collateral damage, thereby limiting harm to civilians, friendly soldiers, and preventing unnecessary damage to infrastructure, while at the same time increasing "targeted" lethality to allow for the destruction of the intended target.

DE 004139373C1 (Held) discloses a fragmentation warhead having a main explosive charge in a fragmentation casing which is closed at both ends by end plates. Deformation charges which extend in the longitudinal direction are arranged partly around the fragmentation casing. The fragmentation casing and the main explosive charge are designed to be deformable in order to force the fragmentation casing inwards before fragmentation formation when the deformation charge is detonated on the side facing the target. In order to achieve a situation in which the fragmentation casing is forced in approximately flat on detonation of the deformation charge which faces the target, the fragmentation casing is designed such that it can tear off in the region of the two end plates on detonation of the deformation charge.

FR2704638 (Broussoux et al.) discloses an explosive fragmentation weapon having a grooved outer shell with its inner surface at least partly surrounding the explosive charge and its outer surface grooved to form the fragments on detonation. At least some of the outer surface grooves contain an electrically-conducting material with a shape memory effect, elongated in shape and with ends connected selectively to a power supply. The grooves containing the material are rectangular in cross section with two grooves to one of the surfaces of the shell, and a base which lies parallel to it and has a slit in it. The material with the shape memory effect is a copper/nickel/aluminum alloy, and the grooves lie along the meridians or parallels of the shell.

U.S. Pat. No. 6,484,642 (Kuhns et al.) discloses a fragmentation body for fragmentation projectiles and warheads, including an integral fragmentation shell structure made of cast metal, and the shell structure having and outer wall surface and an inner wall surface separated by a thickness of the shell, where at least one of the inner or outer surfaces includes recesses formed through part of the thickness of the shell to define a plurality of fragments which remain integrated with the shell structure until an explosive forces is detonated in proximity of the shell, wherein the shell material comprises a steel alloy including carbon, chromium, nickel, molybdenum, cobalt, and the balance essentially being iron. Shell structures of the inventive fragmentation body also have a fragmentation pattern defined via recesses or grooves provided in at least one of the inner or outer wall surfaces thereof to define the size and shapes of the fragment projectiles desired. The steel alloy used is high strength, yet controllably fragmentable into desired and uniform individual projectile shapes and sizes, and in a desired overall dispersion pattern, during case break up.

U.S. Pat. No. 3,820,461 (Wilhelm et al. discloses a fragment layer for a warhead having a longitudinal axis comprising: a plurality of axially adjacent, annular rings of preformed fragments, each said ring being coaxial with said axis and encompassing the periphery of said warhead; an annular retaining layer covering the outside surface of said rings to secure said fragments in position; and annular explosive layer disposed between said rings and the periphery of said warhead; and means for selectively detonating said explosive layer to generate a low velocity disc pattern of fragments.

U.S. Pat. No. 4,026,213 (Kempton) discloses a cylindrical warhead having an outer, relatively-thin metal skin member and an inner thicker metal casing, the main explosive charge being disposed in the space between the members with associated boosters or charge initiators. The initiators include a first set of circumferentially-spaced aiming detonation members and a second set of similarly spaced main charge-firing members. Aiming is achieved by first firing a selected aiming initiator to produce a force sufficient to rupture and break open an arcuate section of the outer warhead skin but insufficient to produce a main charge detonation. Next, a main charge-firing initiator disposed substantially diametrically opposite the ruptured arcuate section is fired to produce an inwardly-directed main-charge blast for fragmenting the thicker inner casing and driving the fragments in the desired direction through the ruptured arcuate section.

SUMMARY OF THE DISCLOSURE

Given the parameters of modern urban warfare, it is advisable to have a warhead which further limits the number and direction of fragments following detonation. To that end, the present disclosure is directed towards a warhead that uses a set of small explosive charges that are located on the inside or outside of the steel casing and are in intimate contact with the warhead casing. The charges are specifically designed to produce longitudinal cracks in the warhead casing when the warhead is detonated (which may or may not be simultaneous with these small charges.)

More specifically, the shacks that are driven through the casing will generate high tensile stresses where they interact with one another, resulting in cracks in the casing that are perpendicular to the two detonation points where the shocks originated. When the warhead itself is detonated, the stress from the expanding gases and shock momentum will cause these cracks to run some portion of the length of the warhead, casing very rapidly at approximately the speed of sound in the casing, which corresponds to 16,000 feet per second for steel, thereby releasing the stress early, resulting in fewer but larger shell casing fragments. Additionally, these cracks will preferentially direct the fragments at an angle downward (toward the ground) rather than outward. The end result is a lowered fragmentation lethality for the warhead, a small increase in the blast output of the warhead, and lower collateral damage in the areas away from the bomb.

In one embodiment of the disclosure a row of charges are positioned around and on the outside of the perimeter of the casing of the warhead. When detonated either simultaneously or a few milliseconds before the detonation of the charge inside the warhead, the warhead casing is cracked during the initial detonation. This early, low pressure fracture will cause the casing to fragment into large pieces and to separate from the explosive fill.

In another embodiment of the disclosure, several rows of detonators are placed along the outside edge of the warhead parallel to the axis. The row of detonators opposite the intended target are fired simultaneously resulting in enhanced fragment energy being projected toward the target. In other words, when all the rows of detonators are fired simultaneously the warhead casing can be fragmented during the initial detonation occurring adjacent to the casing. This early, low pressure fracture will cause the casing to fragment into large pieces and to separate from the explosive fill before the strong shock form the opposing detonation arrives.

In another embodiment of the disclosure, a series of charges can be positioned around the inside of the perimeter of the casing of the warhead. When all the rows of detonators are fired simultaneously the detonation is driven toward the center of the warhead rather than outward toward the casing walls. This results in the casing being broken up by weaker shocks which results in larger fragments of lower energy. These fragments move outward and cause the density of the adjacent detonation gases to decrease so that the strong shocks coming from the detonators on the opposite side of the warhead do not break them up further. This embodiment is further improved by the incorporation of a tube shaped liner inside the warhead that is coaxial to the warhead.

In another embodiment of the disclosure, the charges have a geometric shape. In one embodiment, the charges are diamond shaped. The charges can also be rectangular, square, or even circular.

In another embodiment of the disclosure, the charges surrounding the warhead are detonated simultaneously.

In another embodiment of the disclosure, the charges surrounding the warhead and the charges within the warhead are detonated simultaneously.

In yet another embodiment, the charges are attached to a collar which is fitted or even bolted around the shell of the warhead. The collar may be bolted onto and wired to existing munitions. In another embodiment, the collar is hinged, with a clasp to secure the collar. In another embodiment, there are multiple collars spaced along the axis of the warhead.

In another embodiment, the charges on the inside or outside of the warhead are linear shaped charges. The linear shaped charges may extend the whole length of the warhead or only a portion of the warhead. The linear shaped charges are detonated either simultaneously or just before the detonation of the main explosive fill to produce deep cuts in the warhead casing such that early fracturing of the casing occurs along those cuts and releases the strain from detonation before the warhead can fully fragment.

In yet another embodiment of the disclosure, the collar is built into the inside of the warhead.

In yet another embodiment of the disclosure, and to enhance this effect, a tubular shaped, annular liner is incorporated into the warhead. The annular liner preferably has a specific shock impedance, is somewhat smaller than the inside diameter of the warhead, and positioned along the entire length of the warhead parallel to the axis.

In yet another embedment of the disclosure, the collar is used in combination with an annular liner.

BRIEF DESCRIPTION OF THE DRAWINGS

Other embodiments of the present putting device will be evident from the following detailed description, with like reference numbers referring to items throughout.

DETAILED DESCRIPTION OF THE DISCLOSURE

Figure 4:
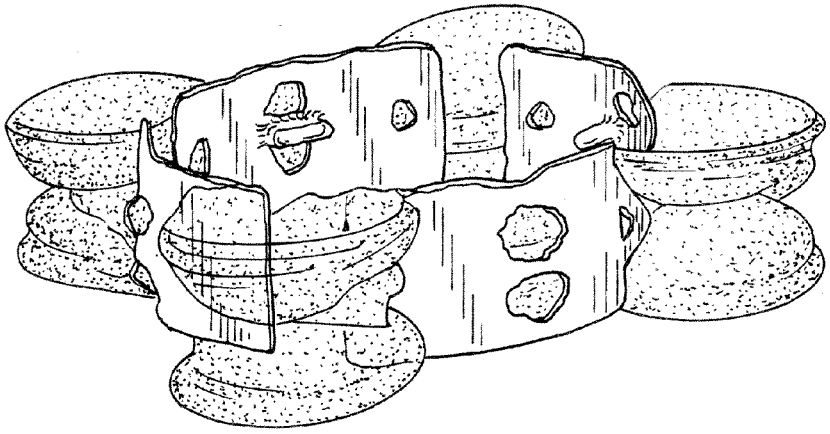
FIG. 4 is illustrates the predicted early-stage gas venting from multipoint detonation warhead.
Figure 5:
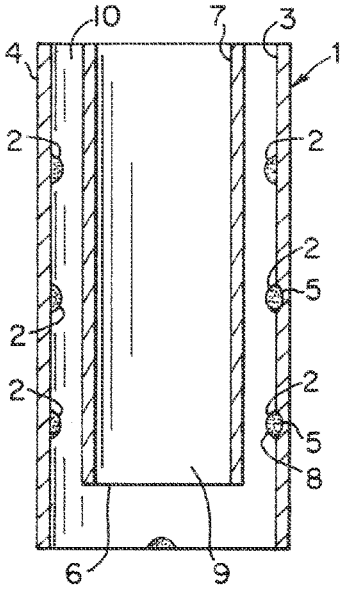
FIG. 5 is a cross section of a warhead having an annular liner integrated into a multipoint detonation warhead.

Referring to FIG. 5 of FIGS. 1-19, a multiple point detonation warhead 1 is comprised of a plurality of multiple detonation sites 2 (also referred to as initiation points 2) positioned along the walls 3 of the casing 4. The casing 4 itself may be made of any conventional material, but is usually steel or copper, or an alloy material. Materials may also include polymers, composite materials, or a material matrix of fragments, polymers, and fibrous materials. The walls 3 of the casing 4, which is preferably tubular, are approximately 6.35 mm (¼ in) in thickness, with a range from about ⅛ inch to about ⅝ inch. The thickness of the walls 3 may also fall outside these parameters. The charges may be positioned against the wall 3, or they may be fitted within an alcove of the wall 3.

The charge 8 at each of the detonation sites 2 may be a conventional charge 8, such as PBXN-109 (Plastic Bonded Explosive (Navy)). PBXN-109 is a specific explosive composition developed by the Navy; however, any detonating composition will work, including but not limited to AFX-757 (Air Force Explosive), TNT, Tritonal Composition B, etc. The charge may reside on the inner wall 3 of the casing 4, or there may be a slight indentation 5 on the inner wall into which the charge may fit. The minimum number of charges will be 2 on opposite sides of the warhead 1 and the maximum is the number of charges that can fit around the warhead 1. The optimal number in terms of performance and cost tradeoff is likely between 3 and 6, more likely 4 to 5.

In one embodiment, the walls 3 of the casing 4 surround an annular liner 6. The annular liner 6 is a hollow tube inserted into the empty casing 4. The intent of the annular liner 6 is to interact with the initial detonation being propagated across the warhead 1, producing a reflected shock back toward the casing 4. The reflected shock pressure may be a minor portion (e.g. 30%) of the initial detonation and is intended to impact the casing wall to provide a mild shock to the fragments to help expand them and enhance the venting of the detonation reaction products in the first microseconds (usually, but not limited to the first 20 microseconds or so) of detonation. The annular liner 6 should be thin enough that detonation will propagate across the barrier and continue towards the center of the warhead 1. The annular liner 6 will also help decrease the pressure of the opposing shock by a similar impedance mismatch. Impedance is defined as the product of the sonic speed and density. The annular liner is intended to reflect a portion of the incoming shock back towards the warhead casing. This will result in the warhead casing 1 being accelerated outward slightly faster, it will also retard the progression of the shock originating from the other side of the warhead and will also produce a mach stem effect thereby accelerating the explosive detonation down the length of the warhead between the annular liner and the warhead casing. This results in an enhancement and extension of the reduce fragmentation effects of the multipoint detonation system.

An explosive 8 is poured into the casing 4 such that both the casing and the hollow tube of the annular liner 6 are filled with the explosive. It should be noted that it is not necessary to fill the hollow tube of the annular liner 6 with the same explosive as that in the rest of the casing; two or more different explosives could be used, with at least one type of explosive filling the inside 9 of the annular liner 6 and at least a second explosive filling the space 10 between the annular liner 6 and the inner well 3 of the shell casing 4.

The cross section (or y axis) of the annular liner 6 may be circular or it may have the shape of a polygon having at least three sides. The sides of this polygon may be flat or curved. The detonators charges may be positioned at any set of points in relation to the polygon. The detonators may also be located either in the center of a side or directly at a point where the sides intersect.

A specific approach is to use a tubular shaped material that has an impedance of about twice that of the explosive. In the case of an AFX-757 filled warhead, the target impedance of the annular liner 6 would be 0.66 gm/μsec $cm^2$ (Impedance is the sound speed of the material times the density).

The annular liner (also called a wave shaper) 6 may be comprised of magnesium (as tested below). Alternatively, the annular liner 6 may be composed of a reactive or explosive material so that its mass will react and add to the energy release of the warhead. One example of a reactive material that could be used is a mixture of a fluoropolymer (such as Teflon®) and a metal (such as aluminum). This material would be particularly beneficial due to its reactivity and enhanced afterburning effects. Many other materials could be used, including but not limited to aluminum, steel, copper, zinc, polymers such as polyethylene, etc. the annular liner 6 may also be comprised of glass, lead, or ceramic. The annular liner 6 itself may form the entire explosive core of the warhead 1, when it itself is comprised of an explosive material.

Additionally, the annular liner 6 may be constructed of one or more different materials along its axis. For example one section of the annular liner may be constructed of steel, another of aluminum, and a third of a reactive polymer. This allows for a tailored fragmentation effect for a specific section of the warhead 1. This may be used, for example, to compensate for differing wall thickness and curvature of the warhead casing 4.

The annular liner 6 may also be constructed of two or more layers of different materials. Having the annular liner 6 constructed of two or more different layers of differing impedance allows for the engineering of more reflection occurring in one direction and less reflection in the other. In a further embodiment, the layer or material having the lowest impedance would be on the inside of the annular liner 6.

In another embodiment, the annular liner 6 may be scored or pre-cut to fail at specific points or lines. This allows for a controlled explosion, which aids in the "channeling" of the explosion such that the casing 4 of the warhead 1 breaks into several large pieces instead of hundreds of pieces of shrapnel.

The annular liner 6 can run the entire length of the warhead 1 but will normally be less than the full length, preferably, the annular liner 6 may be from about 80% to about 100% that length of the casing, although it is anticipated that the length of the annular liner could actually be less than 80%. The annular liner 6 should be long enough to affect the beam-spray area of the warhead at a minimum 1. The annular liner 6 further could have a tubular shape, thus allowing an axial detonation to propagate unhindered down both the inside and outside of the annular liner 6, thereby maintaining baseline lethality as shown in the Figures. Specifically, the annular liner 6 will be short on the end (normally the distal end) that the normal detonation booster and fuze are located as this will allow the warhead 1 to detonate as intended and produce the normal high level of fragmentation for which it was designed. The incorporation of the liner inside the warhead increases the fragment energy of the casing when it is detonated from one end, but will decrease the fragment energy when detonated at the multiple points indicated. The annular liner 6 will actually contribute to, and therefore increase, the baseline fragmentation performance of the warhead 1.

Additionally, holes could be positioned along the length of the annular liner 6. These holes may also be used to allow for liquid cast explosive to flow through the annular liner 6 allowing for a more even filling process. It should be noted that the holes are an option and are not necessary to assist the normal axial detonation propagation.

The thickness of the walls 7 of the annular liner 6 will depend upon the intended application and shock initiation properties of the explosive. The walls 7 may vary from about 2-3 millimeters to more than 1 inch. Different explosives have different sensitivities to shock initiation; if the walls annular liner 6 are too thick, detonation propagation may be prevented.

The diameter of the annular liner 6 may range from about 10% to about 99% of the warhead casing 4 diameter, depending upon desired degrees of fragmentation effects. Preferably, the annular liner diameter would be between about 50% and about 80%, or even more.

In an alternative embodiment to having charges placed within the casing, fracturing charges 101 are placed around and are attached to the circumference of the shell casing 102 (FIGS. 9-19). The charge size and thickness varies with the thickness of the steel casing material. In one example, a 0.5 inch thick mild steel casing may require charges that are 0.25" thick and 2 inches on a side (if diamond shaped). Thicker cases will require thicker explosives that are larger in size. If the purpose is also to cause detonation in the warhead explosive through the steel casing wall, then the thickness of the charges 101 would be increased. It should be noted that in addition to steel, the shell casing 102 may be made out of copper, magnesium, aluminum, titanium or a variety of other metals and alloys. At some point, the shell casing may even be made out of a resin, polymer or composite material, consisting of a metal filament or fragment and a polymer.

The fracture charges 101 are preferably connected to one another by a band or some other means.

In one embodiment, the fracture charges 101 are attached to collar 104 that fits around the shell casing 102, forming a fragmentation control collar 105. The fracture charges 101 may be attached to the collar 104 any number of ways. In one embodiment, the charges are seated within distinctly shaped cavities 140 within pockets 120 or containers that are integrated with the control collar 104 itself. Each cavity 140 of each pocket 120 is shaped for a particularly shaped charge. These shaped pockets may be already attached to the collar when the fracture charges are loaded, or the shaped pockets may be loaded and then attached to the collar. Additionally, the collar 104 itself may be hollow, to allow additional packing of fracture charges 101. Small openings 123 in the top of the collar allows for insertion of detonators.

In another embodiment, the fracture charges 101 may be glued, bolted, or screwed to the collar. Alternatively, the fracture charges 101 may be attached to the collar 104 by the use male-female clips. Snap clips and other such devices may also be used to secure the fracture charges 101. There are a number of ways in which the fracture charges 101 may be secured to the collar 104 to form a fragmentation control collar 105. In one embodiment, the fragmentation control collar 105 may be removably attached to a warhead. In yet another embodiment, fracture charges 101 may be directly attached to the shell casing 102 by means of glue, male/female clips, bolts, snap clips, or just about any other means.

Figure 12:
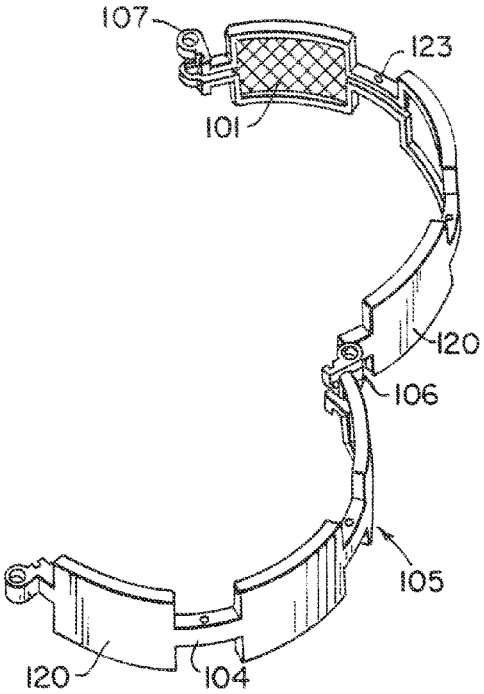
FIG. 12 is a perspective view of the unhinged fragment control collar.
Figure 11:
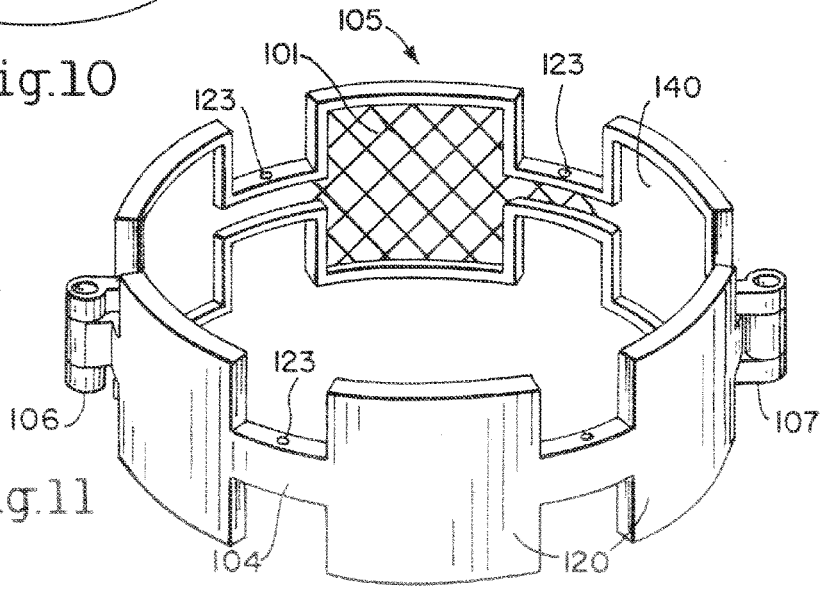
FIG. 11 is a perspective view of the fragment control collar, by itself.

The number of fracture charges 101 positioned around the shell casing 102 may vary from one to five or more fracture charges 101, five fracture charges 101 appear to work well for the purposes of the disclosure. The fragmentation control collar 105 may be attached to the shell casing 102 by any number of means. The fragmentation control collar 105 may be bolted, glued, or even welded onto the shell casing 102. In one embodiment, the fragmentation control collar 105 is hinged 106, and has a latch 107, which, when closed, secures the fragmentation control collar 105 to the shell casing 102 of the warhead 103 (FIGS. 11 and 12). The use of hinge 106 for the fragmentation control collar 105 is not a requirement; however, the hinge 106 will make it easier to install the fragmentation control collar 105. A metal belt or band with a lever tightening method may also be used to attach the fragmentation control collar 105 to a warhead casing 102. Other method exist for attaching the fragmentation control collar 105 to a warhead 103.

Having the fracture charges 101 attached to a fragmentation control collar 105 has a number of advantages, not the least of which is the ability to retrofit older bombs with the fragmentation control collar 105 such that their fragmentation is limited and directed, thereby limiting collateral damage. The fragmentation control collar 105 can be used with or without the annular liner 108. Similarly, the annular liner 108 may be used with or without the use of fracture charges 101.

Figure 17:
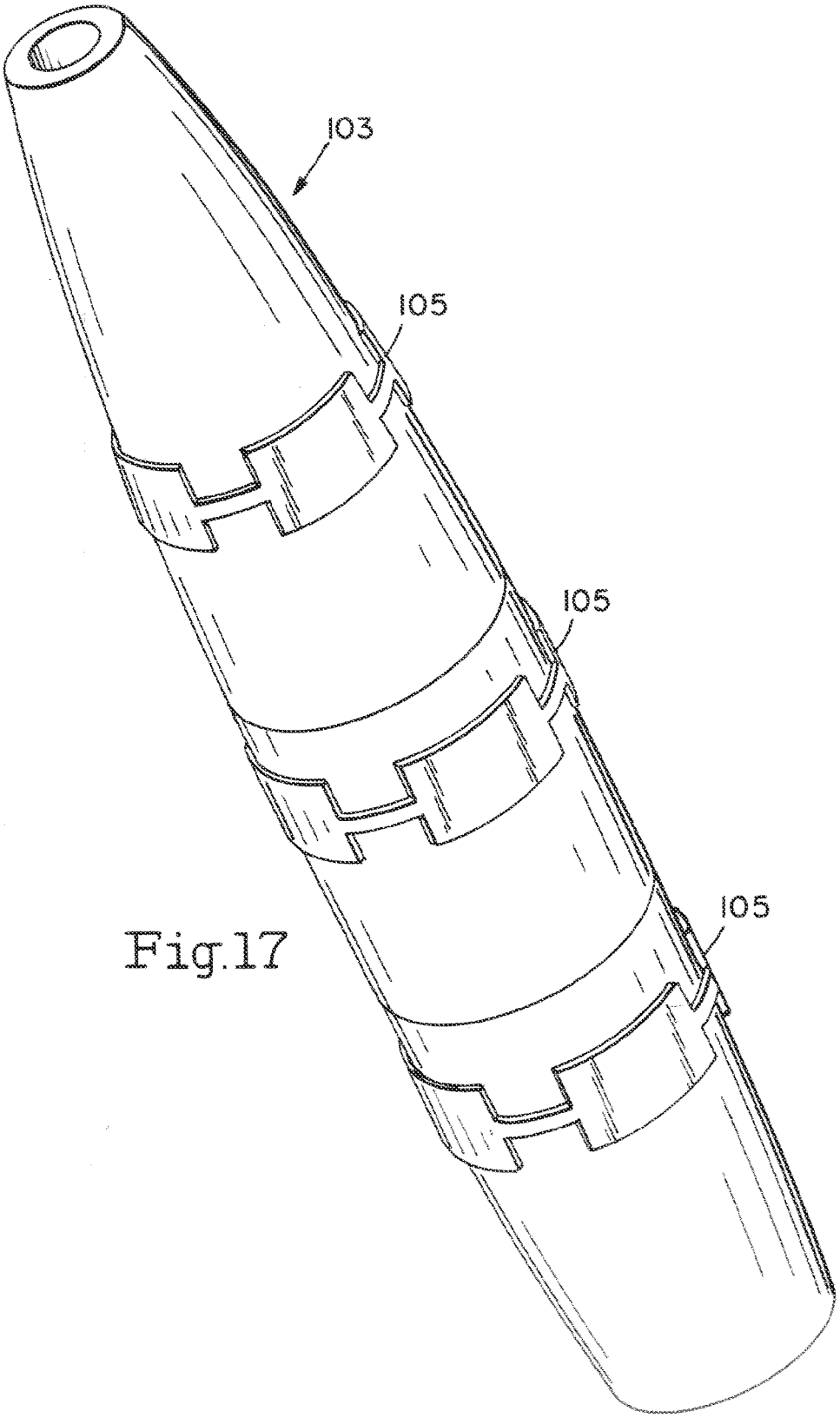
FIG. 17 is a drawing showing a plurality of fragmentation collars positioned around the warhead casing
Figure 19:
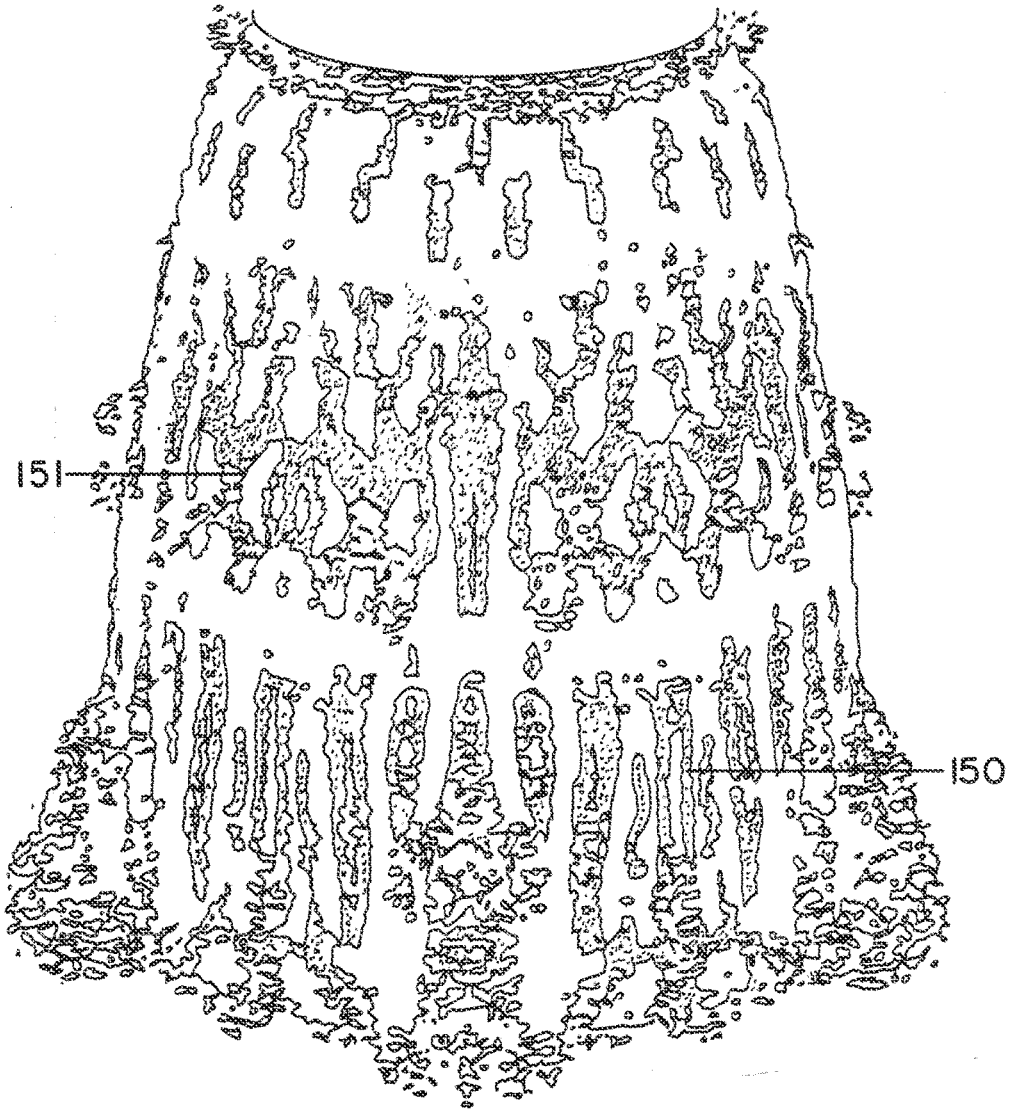

It should also be noted that in one embodiment of the disclosure, there are multiple fragmentation control collars 105 positioned around the outside of the warhead casing 102, with the fracture charges positioned in any number of positions along the length of the warhead (FIG. 17). Similarly, there can be multiple fragmentation control collars used inside of the shell casing, positioned between the annular liner and the shell casing 102.

In one embodiment, the fracture charges 101 themselves are prematurely detonated surrounding the shell casing 102 or they may be simultaneously detonated with the charges with the standard fuzing initiation system of the warhead within the shell casing 102. Premature detonation of the fracture charges normally occurs anywhere from about 20 microseconds to about 200 microseconds prior to the detonation of the main charge within the shell casing 102. The number of microseconds for the premature detonation may fall outside the parameters given. In another embodiment, simultaneous detonation of charges occurs.

In one embodiment, the fracture charges 101 on the outside of the shell casing has its own ignition or detonation system 109 (FIG. 7), or the fracture charges can share the detonation system of the main charge. This detonation system 109 could be connected to the warhead's fuze such that it is detonated at the time of the main charge, or the primary detonation device could be wired to a delay switch of the fuze, such that would allow for the outside fracture charges 101 to detonate microseconds prior to the detonation of the primary charge inside the casing 102. For reasons of safety and reliability, a central fuze will control the firing of all initiation charges inside and outside the warhead whether delayed or not.

By positioning and detonating these fracture charges 101 around the casing 102, several small longitudinal cracks will begin to form, beginning on the inside 119 of the shell casing 102, and working its way through the metal until it reaches the outside of the shell casing 102. Once there is ignition of the primary charge, the shell casing 102 will break into a limited number of pieces, for example, preferably no more than about 20 to about 30 pieces, although these numbers may vary. This is far less than the splintering of the shell casing 102 which normally takes place. Also, given the early formation of cracks in the shell casing 102, the casing 102 will tend to rupture into long strips which will preferentially change the trajectory towards the ground.

Figure 7:
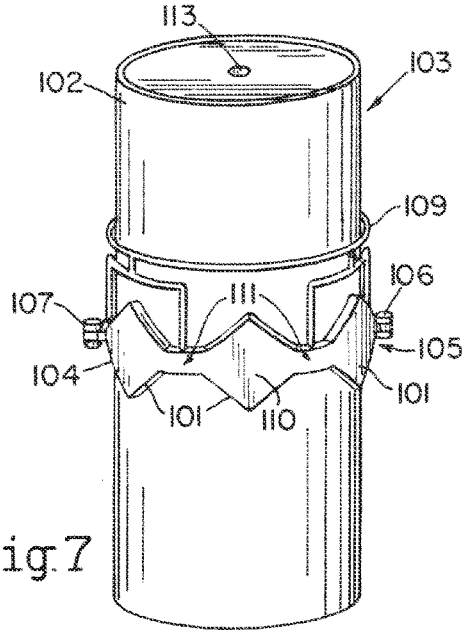
FIG. 7 is a perspective view showing several diamond charges on a fragmentation control collar, with the collar encircling a warhead casing with a detonator point on each end of the diamond charges.
Figure 9:
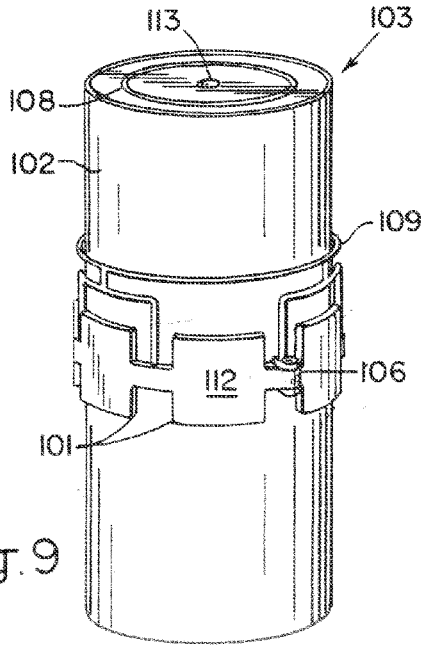
FIG. 9 is a perspective view showing the use of rectangular charges on the fragmentation control collar positioned around a warhead casing.
Figure 8:
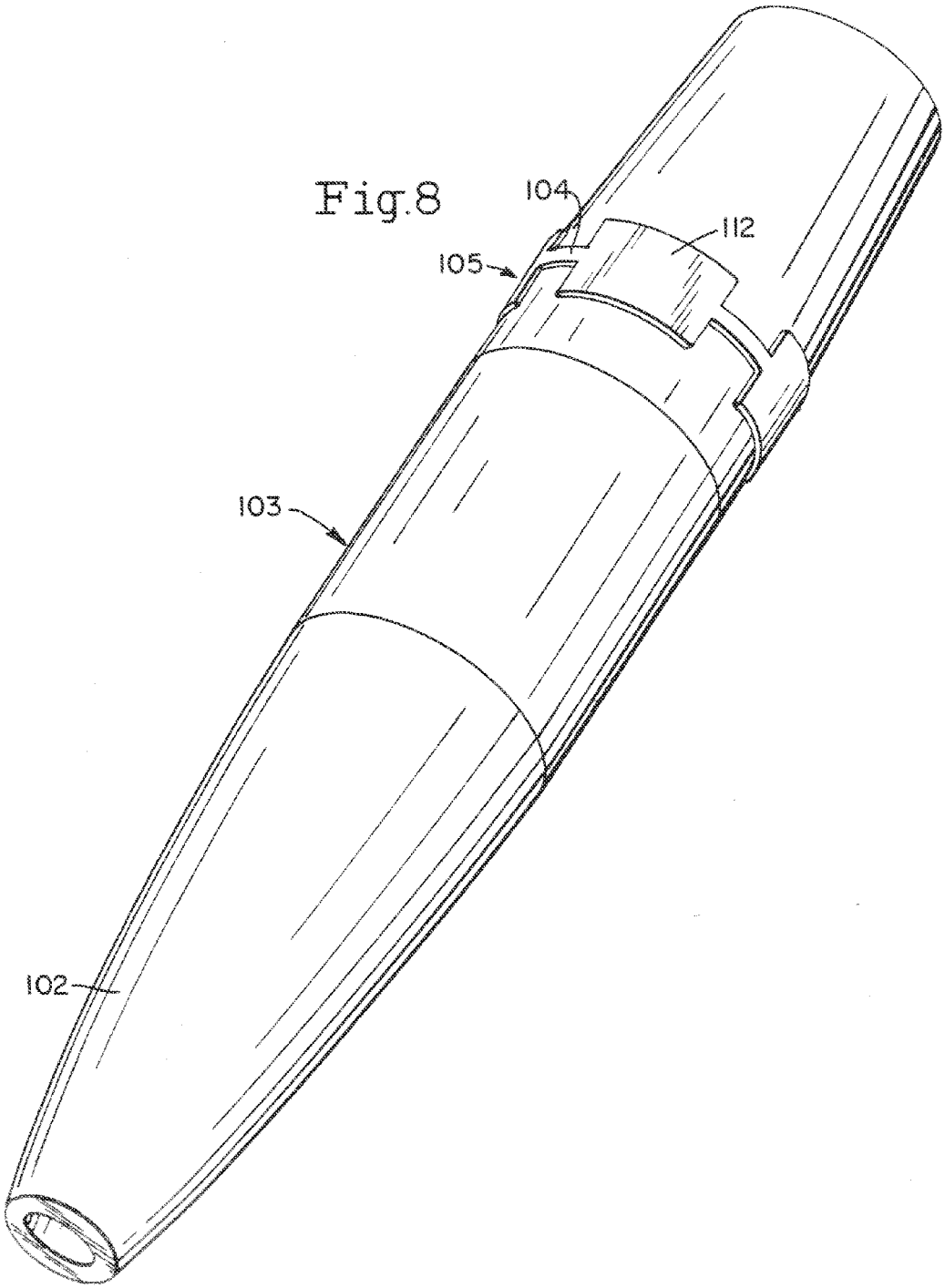
FIG. 8 is a perspective view showing a fragmentation control collar positioned around a warhead casing.
Figure 10:
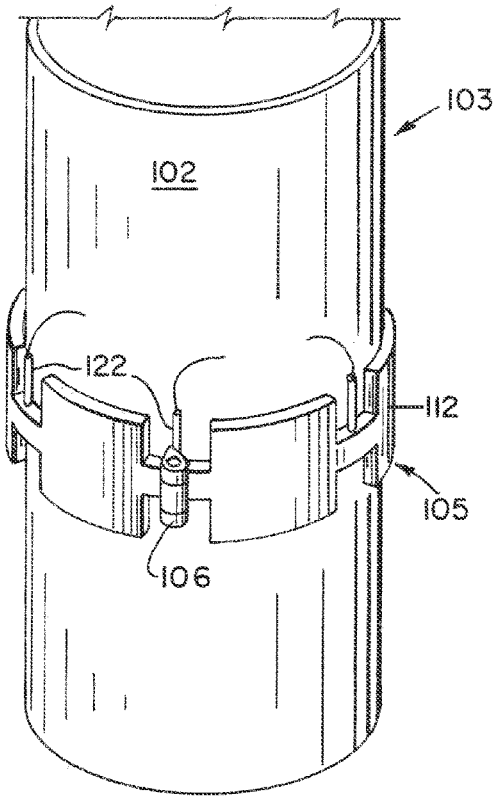
FIG. 10 is a perspective view showing individual detonators on the control collar.

The fracture charges 101 may come in variety of types and shapes. One type of charge is a diamond charge 110 (FIG. 7). In this type of charge, detonator points are positioned on each end 111 of each of the diamond charges 110. The charge(s) can also be rectangular 112, square, or round.

As shown in FIG. 7, the point where normal detonation could be initiated is the end hole 113. The small fracture charges 101 are initiated with a detonation system 109 that will produce simultaneous detonation at the ends of each diamond charge 110.

In another embodiment (FIG. 10), the detonation system 109 can be replaced with individual detonators 122, which are simultaneously triggered. Examples include but are not limited to foil initiators, exploding bridge wire initiators, or hot wire detonators.

A fuze is used to detonate the explosives. The fuze is located at one end of the warhead. Normally, the annular liner 108 will extend approximately ¾ the full length of the casing leaving a gap between the annular liner 108 and the fuze. This is to facilitate the normal detonation of the warhead when the user desires to operate in a baseline mode rather than the reduced lethality mode where the fuze would be the "baseline" center initiation point.

Figure 13:
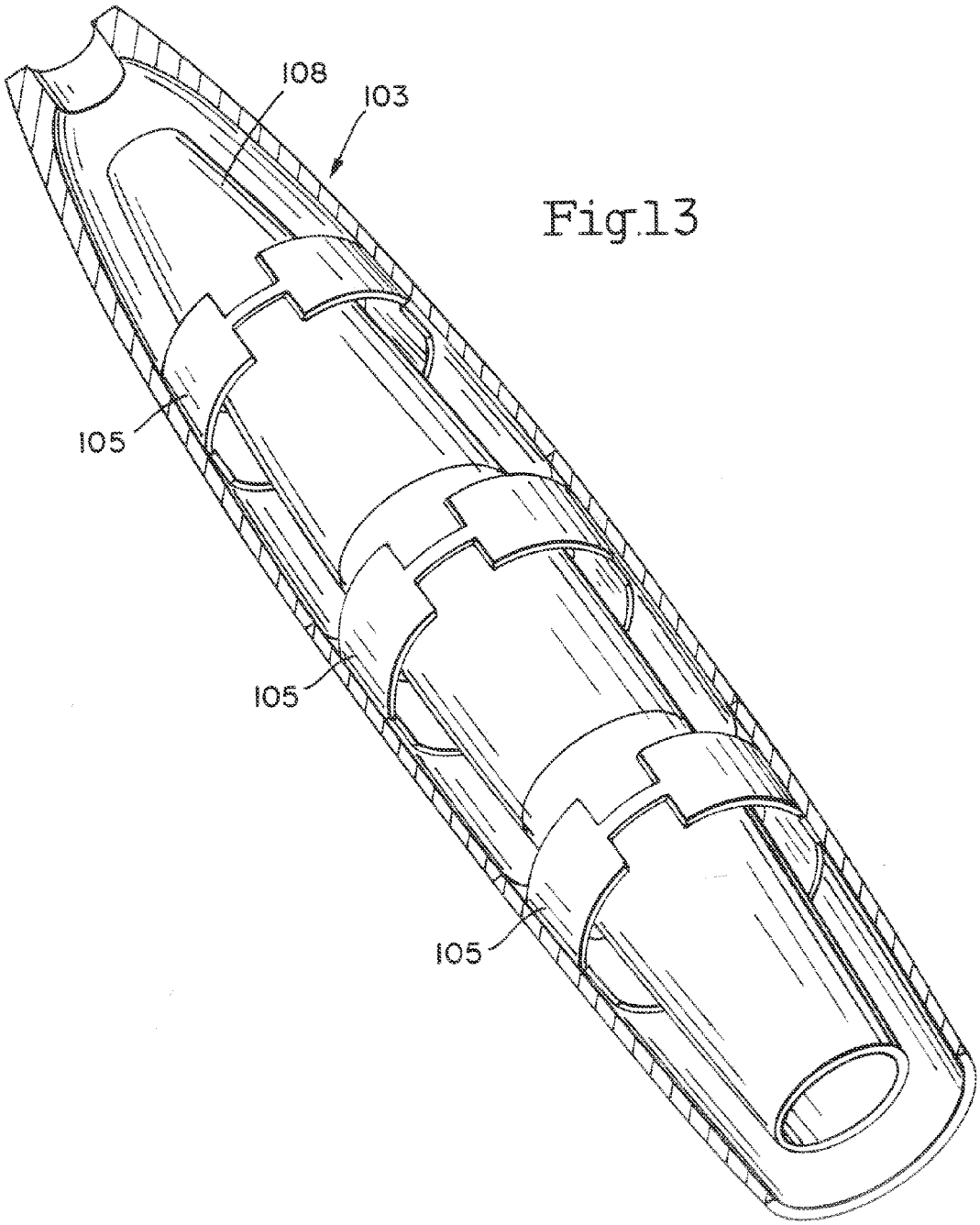
FIG. 13 is a perspective view showing the internal use of a plurality of fragmentation control collars combined with a shock liner.

It should be noted that the fragmentation control collar 105 need not only be placed merely on the outside of the warhead. In another embodiment, as shown in FIG. 13, the fragmentation control collar 105 is inserted into the warhead 103, positioned just underneath and in contact with the warhead casing 102. In one embodiment, the fragmentation control collar 105 is positioned between the warhead casing 102 and an annular liner 108.

Both the internal and external fragmentation control collar 105 applications could be used to both initiate cracks in the warhead casing 102 and also initiate detonation of the warhead explosive fill. This simultaneous detonation of all the fracturing charges, when combined with a "shock liner" as shown in FIG. 13, results in a combined effect of driving the detonation particle velocity inward reducing the strain rate on the warhead casing 102 and the pre-cracking of the casing. The combination of these two specifically designed phenomena will produce an even more effective lowering of the resultant number of warhead fragments, lower fragmentation velocity and therefore lower lethality.

Additionally, there could be a plurality of fragmentation control collars or, more correctly, rings, positioned around the inside of the warhead casing. These fragmentation collars positioned on the inside of the warhead need not have the latches and hinges that are found on some of the variations of the fragmentation control collar positioned on the outside of the shell casing. Also, external and-or internal charges could be used without the use of the annular liner.

Experiments

Using a notional design of a steel casing with four rows of detonators along the walls, a model of the detonation event shows that that process of casing breakup and acceleration occurs later in time than the scenario where the warhead is axially detonated. This late time breakup and acceleration is believed to be indicative of a decreased amount of energy going into the fragmentation. This is also conveyed by analysis of the predicted pressure conditions inside the warhead. While the axial detonation is shown to spike in pressure the simultaneous multipoint detonation indicates a much lower peak pressure and less area under the pressure-time curve.

Figure 1A:
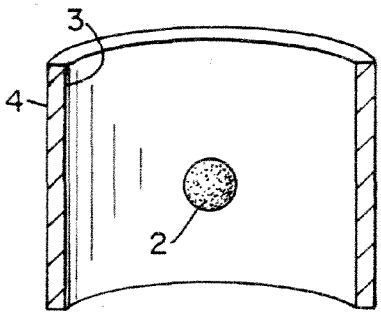
FIGS. 1A and 1B illustrate setups for multipoint initiation simulation.
Figure 1B:
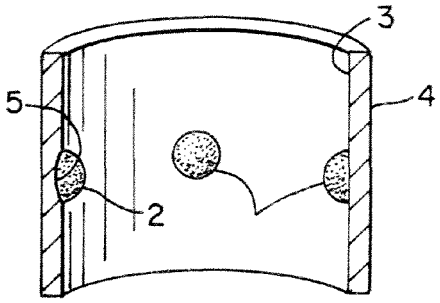

The effect of multiple point initiation on fragmentation effects was modeled by simulating a tube that was 120 mm in diameter and infinitely long with 6.35 mm (¼ in) wall thickness filled with PBXN-109 explosive (FIGS. 1A and 1B). In a baseline case, the explosive was detonated at the center, and in the multipoint case, the explosive was detonated from four separate points around the radius. Eighth symmetry was exploited, effectively cutting the initiator explosive sphere in the left image of FIG. 1 to a ⅛ piece. Also, a fourth symmetry plane was added to complete the infinitely long cylinder. The spheres in FIG. 1 are PBXN-109 modeled using a programmed burn calculation. They are initiated at the start of the simulation from their respective centers, initiating the rest of the explosive charge (transparent material in FIGS. 1A and 1B). The rest of the explosive in the simulation was modeled using the Ignition and Growth of Reaction model. The 120 mm tube was modeled using the Zerilli-Armstrong strength model and Johnson-Cook damage model, with a Gruneisen Equation of State. In an attempt to calculate a more accurate fragment pattern, a Gaussian distribution was used for the initial yield stress of the 4340 steel making up the tube "Measure and ALE3D Simulations for Violence in a Scaled Thermal Explosion Experiment with LX-10 and AerMet 100 Steel;" deHaven, R., Maienschein, J., McClelland, M. Strand, O. Yoh, J.; UCRL-CONF-212828; Jun. 10, 2005 (incorporated herein by reference). The modeling was conducted using ALE3D, an Arbitrary Legrangian Eulerian hydrocode from Lawrence Livermore National Laboratory.

Figure 2:
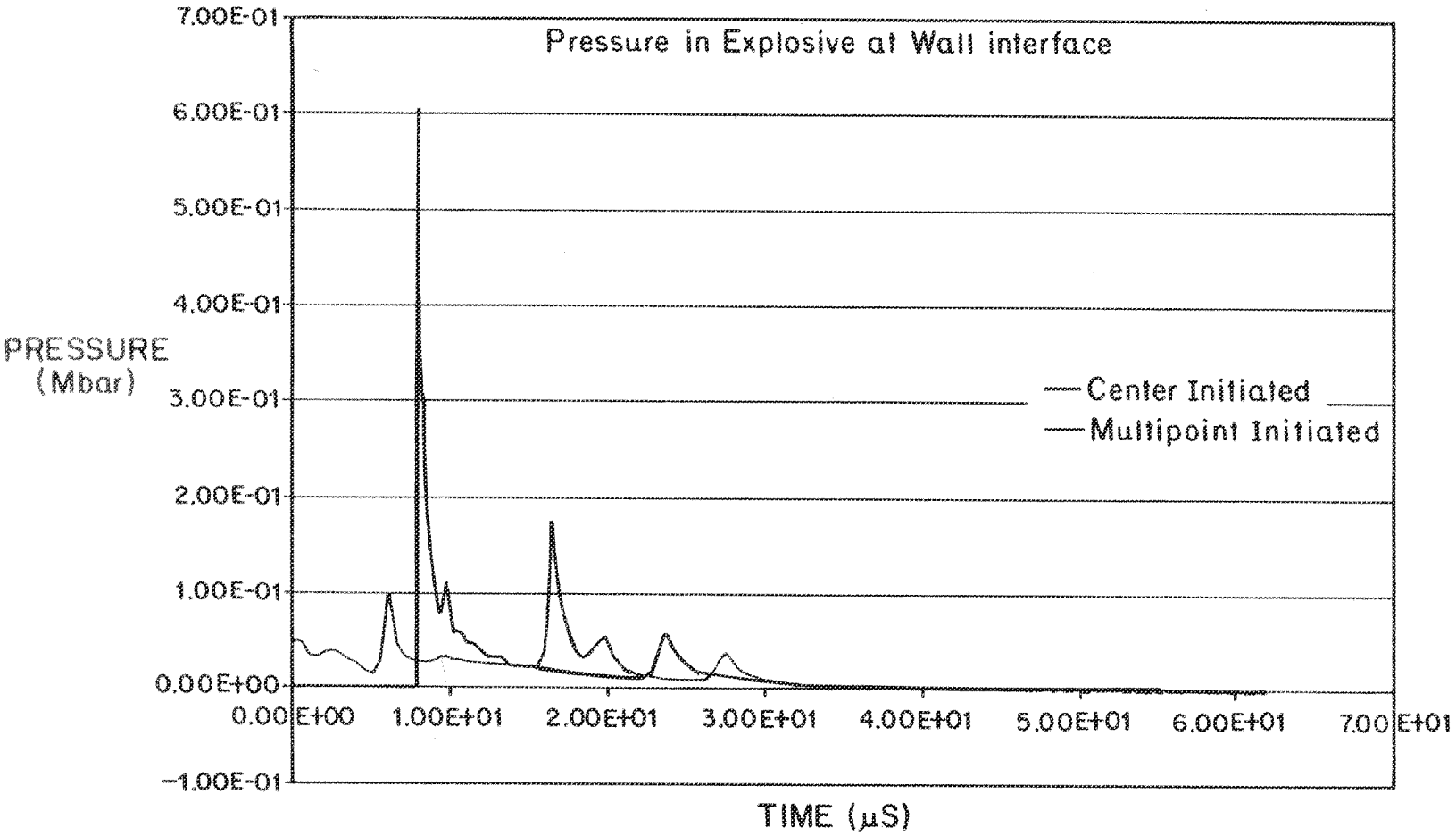
FIG. 2 is illustrates a time history of pressure at Wall/Explosive interface for tracer History Particle 1.
Figure 3:
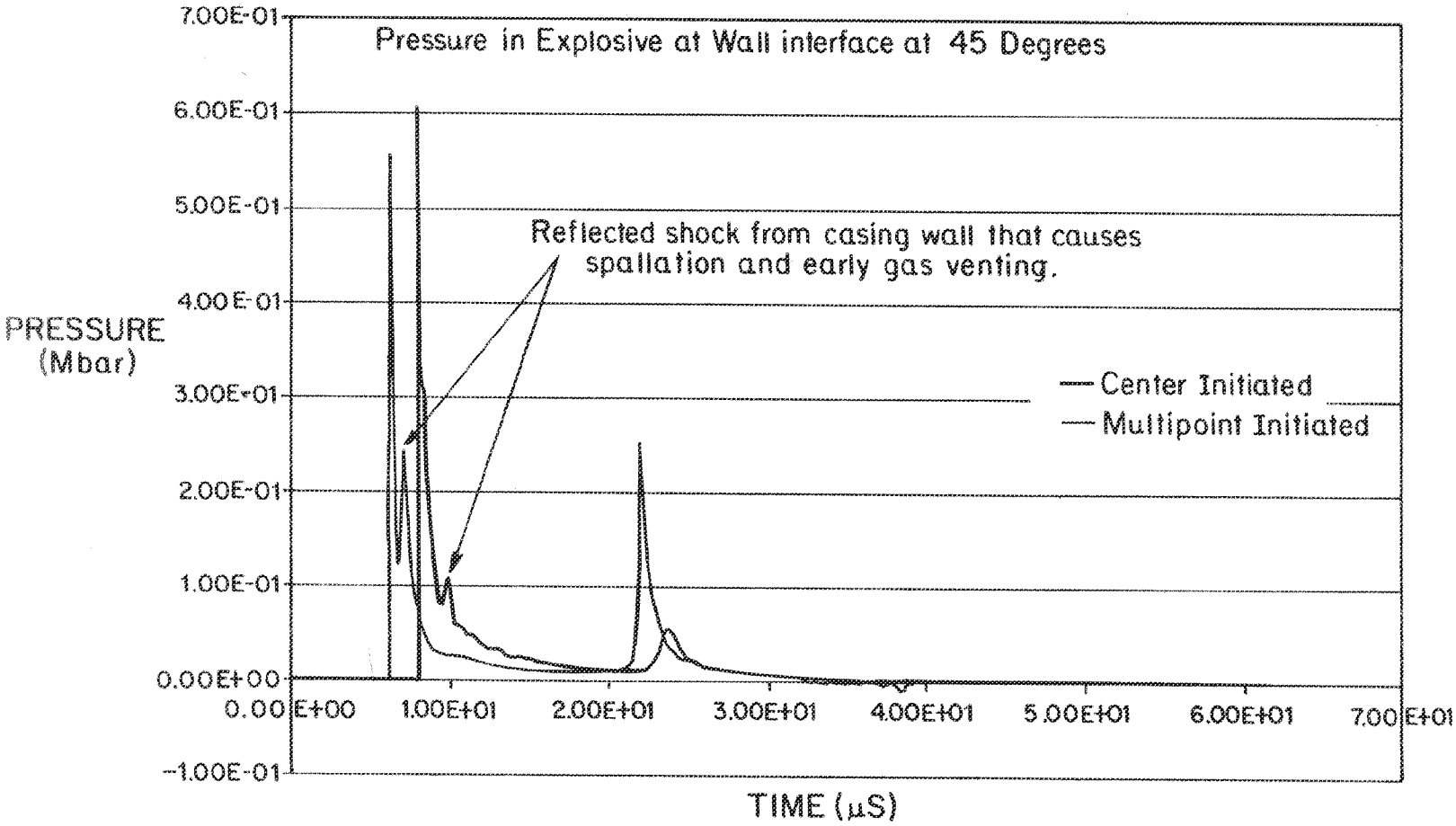
FIG. 3 is a chart comparing the reflected shock from the casing wall caused by the center initiated charges and the multipoint initiated charges.

The fragmentation patterns in the two simulations were quite different. At the intersection of the shocks in both simulations, a fracture is created due to spall generated by the high pressure in the interaction. In the two simulations, the pressure histories at the Wall/Explosive interface were different as well (FIGS. 2 and 3). In the center detonated simulation, a distinctive pressure spike which quickly falls is seen when the detonation front impacts the wall (FIG. 2), at which time the loading begins. This step change in loading pressure causes the case to break up into many small fragments. Also, failures are created due to the interactions of the multiple initiation points along the centerline (due to symmetry). In the multipoint simulation, a much weaker pressure spike is seen at the beginning but the pressure is sustained until the shock created by the opposing detonation point arrives. This allows much larger fragments to be created for two main reasons. First, the case is fragmented into four large fragment strips early in the simulation due to spall created by the interaction of the shocks. In FIG. 2, pressure traces taken for both simulations at the point where the two shocks interact are shown (see FIGS. 1A and 1B for their location). Notice that while the initial peak pressure in the Multipoint simulation is lower than that of the Center Initiated one, the second peak which arrives just after the first is much higher. This second peak is caused by a transmitted shock from the steel back into the explosive product gases. This shock is so strong at this point because it is the coalescence point of multiple shocks. Due to the lower peak loading pressure and longer duration, lower strain rates are generated in the material, allowing larger fragments to form.

While this is a promising start, the difference in estimated fragment size and speed is not dramatically different. It appears that while the fragments are exposed to weak initial shocks that break them into large pieces, their initial acceleration is not fast enough to allow sufficient detonation gases to vent between the fragments, thus reducing the density of the reaction products still inside the warhead as shown in FIG. 4. The density of these reaction products must decrease so that the strong shocks being driven from the opposite side of the warhead cannot efficiently propagate to the casing walls. As shown in the case of the multipoint detonation application, it appears that the strong secondary shocks interact with the casing fragments to some extent and produce some additional late time breakup of the fragments. It is understood that in the case of multipoint detonation, the shocks that originate from the opposing side of the warhead will meet the adjacent detonation in the middle of the warhead. This means that the shocks that subsequently propagate back toward the casing walls are non-reactive shocks because the material in the warhead has already detonated.

Further, the concept was improved by showing that an including annular liner material of appropriate impedance properties enhances the reduction of fragmentation of the explosive warhead. In this case, an annular liner constructed of magnesium metal was used. In one embodiment, the annular liner has an impedance that is different than the explosive, with one embodiment having an annular liner having an impedance twice that of the explosive.

The effect of the multipoint detonation is limited to a specific area of the warhead body determined by the warhead diameter and the distance between the detonators. This is called the "effected area". For this 12 inch long explosive warhead, the effected area was approximately 8 inches. The consequence of this is that a full scale warhead will need to have set of circumferential detonators located a specific distance apart to ensure that each set's effected area has some overlap. For instance, a 500 pound bomb, which is approximately 14 inches in diameter and 48 inches long, may require 3 sets of detonators spaced equidistant along its length to have the desired fragmentation effect. From the images shown it has been observed that the annular liner acts to extend the effected area to longer area than that of the purely multipoint detonated case. This would mean that a smaller number of sets of detonators can be used in a bomb to obtain the enhanced effects resulting in a lower cost initiation system with the possibility of only one set of circumferential detonators is used per weapon to effect this result.

Figure 6A:
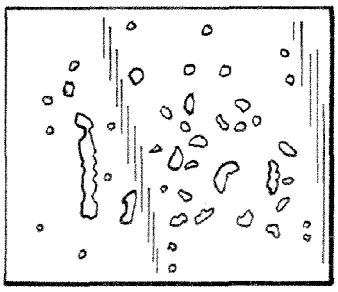
FIGS. 6A, 6B, and 6C are images showing the effects of multipoint and annular liners on fragment patterns.
Figure 6B:
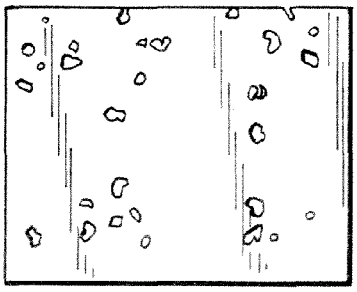
Figure 6C:
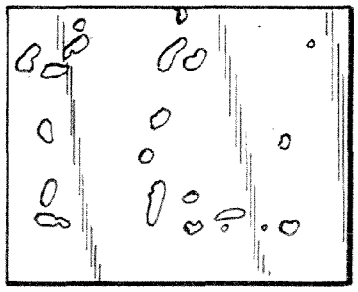

The result of the annular liner test is shown in FIGS. 6A, 6B, and 6C, which illustrate the modified test article with the annular liner and comparison fragment hole panels. The effects are best illustrated by analyzing all the fragment panels (FIGS. 6A, 6B, and 6C) side by side. The first high resolution digital image were taken and analyzed using the automated image analysis software Image Pro Plus® to determine the exact number of holes, their individual diameters and represented area. This data was analyzed to determine the exact changes to the fragmentation performance of the warhead by comparing number of holes, average area and total area represented by the holes. Total area is important because it is an indicator of the quantity of metal that was fragmented. The totals for each panel are roughly equal to each other indicating that all the metal on the side of the warhead facing the panel is accounted for in the fragment panels, i.e. there are no large metal sections unaccounted for. The image on the far left (FIG. 6A) show the fragmentation effects from the baseline charge. The middle image (FIG. 6B) shows the multipoint detonation without an annular liner, and the image on the right (FIG. 6C) shows the effects of a multipoint detonation with an annular liner. The three images together illustrate the decreasing number of fragment holes as one moves from the baseline charge to a multipoint detonation with an annular liner. The panels are backlit to clearly show through holes in the panels.

Table 1 summarizes the fragmentation data. It is important to note that the area for one unusually large fragment in the baseline warhead was not counted. It was statistical outlier probably caused by a weld seam in the test article and was therefore ignored.

TABLE 1

Fragment hole analysis results.

| | BASE-LINE WAR-HEAD | MULTI-POINT W/O ANNULAR LINER | MULTI-POINT W/ ANNULAR LINER |
|---|---|---|---|
| Number of Fragments | 50 | 33 | 23 |
| Relative Number of Fragments | 100% | 66% | 46% |
| Average Area (sq. mm.) | 180 | 241 | 453 |
| Relative Change in Average Area | 100% | 134% | 252% |
| Total Area (sq. mm.) | 9003 | 7955 | 10429 |

As proof of concept, testing was conducted to determine if the fracture charge technology could be used to put a longitudinal crack in a steel plate. Diamond shaped charges have long been used to crack steel plates, but they are not typically arranged, such that the cracks that are created will be parallel to one another. The diamond charge is able to crack a plate because of the way it is initiated. The charge is detonated in two corners of the diamond opposite one another, which drives two shockwaves into the steel, wherein the two shockwaves collide, such that a crack is created because of the extremely high tensile stresses caused by the opposing shockwaves. To investigate this, the test matrix is presented in Table 2, below

TABLE 2

Test Matrix

| Test # | Plate Size (in) | Diamond Size (in) | Diamond Thickness (in) | Number of Diamonds | Crack Depth (in) | Notes |
|---|---|---|---|---|---|---|
| 1 | 12 × 12 × 0.25 | 1.5 × 1.5 | 0.125 | 1 | ~0.0625 | Poor Depth |
| 2 | 12 × 12 × 0.375 | 1.5 × 1.5 | 0.25 | 1 | 0.307 | Successful Crack |
| 3 | 12 × 12 × 0.5 | 1.5 × 1.5 | 0.25 | 1 | 0.15 | Crack due to spalling |
| 4 | 12 × 12 × 0.5 | 2.5 × 2.5 | 0.25 | 1 | 0.355 | Successful Crack |
| 5 | 12 × 24 × 0.5 | 2.5 × 2.5 | 0.25 | 5 | Assumed 0.355 | All Successful Cracks |

As reported in the table above, twelve inch by twelve inch plates of varying thickness were used as target plates for the charges. After test number one, two one eighth inch Primasheet charges were stacked on top of one another to increase the energy imparted to the plate. Test number three resulted in a poor crack. Which caused the diamond charge to be redesigned from a 1.5 inch edge length to a 2.5 inch edge length. Images of the charges used in the explosive testing are displayed in FIG. 14. Because the intent of the test series was to successfully generate 5 parallel cracks in a half inch thick plate (test number five), modifications were made to the charge in tests one through four.

Figure 14:
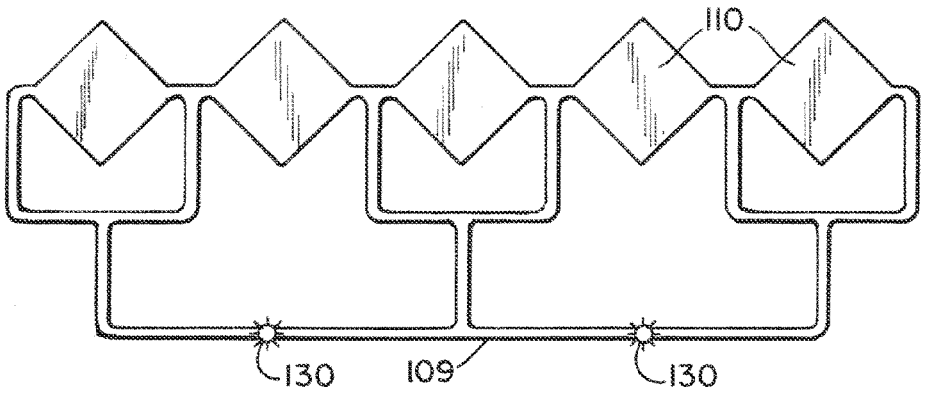
FIG. 14 is a schematic drawing of the primasheet charges used in testing.

To assure that both corners of the diamond charge were initiated at the same time, a single RP-83 initiator was placed in the center of the material extending from the charge 130 (Stars in FIG. 14). Foam blocks were placed over the charges and tape was used to ensure that the charge was in intimate contact with the plate prior to initiation.

Figure 15:
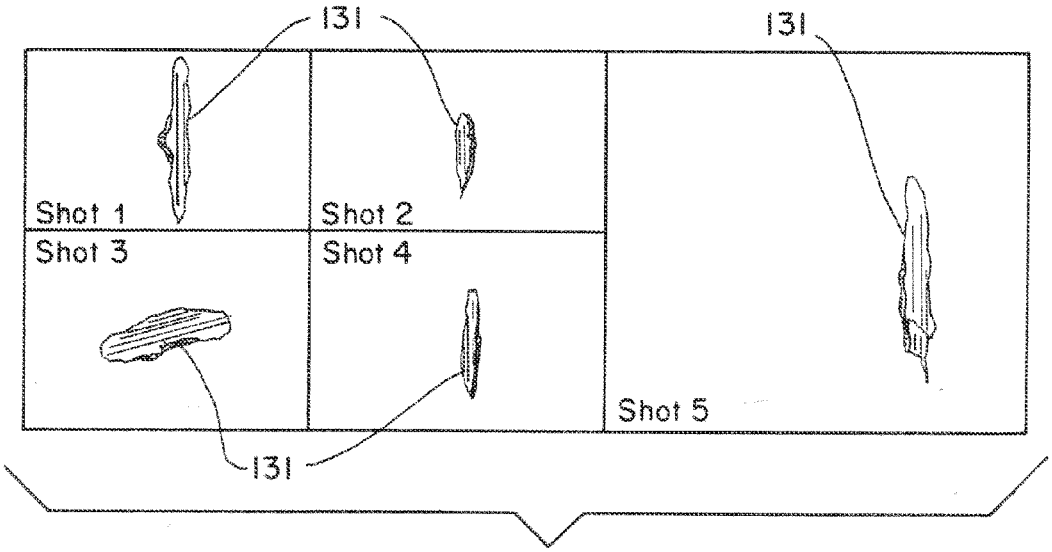
FIG. 15 show images of cracks generated during the fragmentation control collar testing.
Figure 16A:
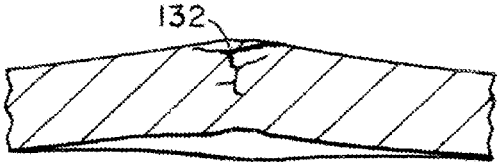
FIGS. 16A, 16B, 16C, and 16D illustrate cross sections of cracks generated in tests 1-4.
Figure 16B:
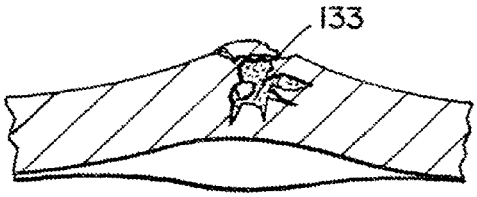
Figure 16C:
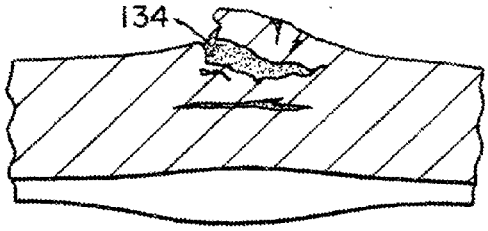
Figure 16D:
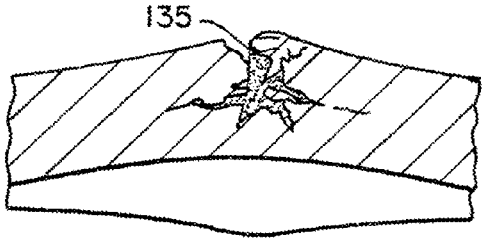
Figure 18:
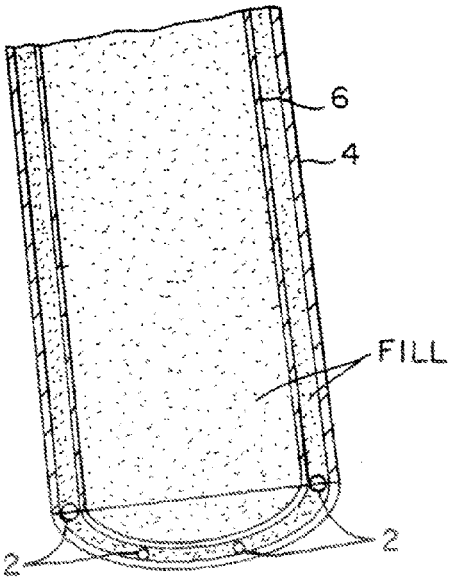
FIG. 18 is an image of the model set up; and, FIG. 19 is an image showing the warhead fragmentation.

FIG. 15 illustrates the cracks 131 created in the plates during testing. After the first test created a crack of suspect depth (FIG. 16A), it was assumed that the charge needed to be at least half the thickness of the plate being cracked. Therefore, the thickness was doubled for the test into the ⅜ inch plate (FIG. 16B), which resulted in a good, deep crack 133 as reported in Table 2 above. When this configuration was used in test number three for the half inch plate (FIG. 16C), the crack 134 appeared to be more due to spall than due to the colliding shockwavers. Consequently, it was decided that the best course of action would be to increase the diamond size, as opposed to the thickness. The resulting crack 135 in test number four (FIG. 16D) closely resembled the well-formed crack 133 generated in test number 2. The successful configuration used in test number four was used for multiple charge test in test number five (FIG. 5), resulting in five identical, parallel cracks 131 in the large half inch thick plate.

It has also been proposed to use multiple initiation points in combination with annular wave shapers in a warhead to prematurely fragment a warhead's casing. The fragments generated by a warhead detonated using these two methodologies are larger than their traditionally generated counterparts. Testing verifies that the premature cracking in the warhead's casing locally decreases the strain rate seen in the casing material. The lower strain result in larger fragments being formed because of increased ductility in the material at the lower rates. The method involves using rings of detonators. The colliding shockwaves create longitudinal cracks in the warhead casing. The object of this modeling effort was to investigate whether these cracks will continue to propagate the full length of the warhead casing, or if they will terminate and transition back to traditional fragmentation performance.

A test was performed to determine how well a warhead casing with an annular liner combined with initiation points just under the outer casing would perform.

The warhead casing's dimensions were twenty-four inches long with a five inch outside diameter, and one eighth inch wall thickness. The annular liner which ran the full length of the pipe bomb had an outside diameter of four inches and one eighth inch wall thickness. Six detonators were placed around the center of the length of the shell casing; this allowed a symmetry plane to be placed at half the length of the pipe. To further reduce the model size, a one twelfth symmetry model was used. The placement of these symmetry planes can be visualized in FIG. 18. The steel liner and casing were modeled as 4130 steel using a variety of material models.

In the simulation using the model described above, the fragmentation transforms quite abruptly from the long, strip-like large fragments 150 (FIG. 19) into the small, fast fragmentation 151 normally seen from axial warhead detonation at approximately five inches along the pipe axis from the initiation ring, yielding a total affected length of about ten inches. It is likely the length of the fracture is a function of charge diameter, circumferential distance between the detonators, or both. Increasing the circumferential distance between the detonators (using less detonators in the ring), should allow the impact angle between the colliding shockwaves to flatten out further down the warhead. Similarly, increasing the warhead diameter will cause the angle between the detonation wave and the warhead casing to approach that of a traditional warhead initiation further down the warhead.

Many modifications and variations of the present disclosure are possible in light of the above teachings. It is, therefore, to be understood within the scope of the appended claims the invention is to be protected otherwise than as specifically described.

The invention claimed is:

1. A warhead comprising:

a) a casing;

b) an annular liner positioned longitudinally within the casing, the annular liner being hollow;

c) a plurality of fracture charges positioned around the annular liner, the plurality of charges being positioned at the circumference of the casing on an inner wall of the casing;

d) a first explosive within the annular liner;

e) a second explosive positioned between the annular liner and the casing; and, f) a mechanism for detonation, wherein the fracture charges have the ability to initiate cracks in the casing.

2. The warhead of claim 1, wherein the first explosive within the annular liner is different from or identical to the second explosive positioned between the annular liner and casing.

3. The warhead of claim 1, wherein the annular liner is in the shape of a hollow tube, or in the shape of a polygon having at least three sides, wherein the sides of the polygon are flat or curved.

4. The warhead of claim 1, wherein material for the annular liner is selected from the group consisting of magnesium, aluminum, zinc, polymers, ceramics, glass, steel, copper, steel alloy, copper alloy, polymers, composite materials, and a material matrix of fragments, polymers, and fibrous materials.

5. The warhead of claim 1, wherein an impedance of the annular liner is between a factor of about 1.25 and about 25.0 times that of the first explosive.

6. The warhead of claim 1, wherein the annular liner is from about 60% to about 100% of the length of the casing, and wherein the diameter of the annular liner is from about 10% to about 99% of the diameter of the casing.

7. The warhead of claim 1, wherein the plurality of fracture charges are positioned in a single plane on the inner wall of the casing.

8. The warhead of claim 1, wherein the charge size and thickness of each fracture charge varies with the thickness of the casing.

9. The warhead of claim 1, wherein the mechanism for detonation is a detonation system separated from the plurality of fracture charges within the casing.

10. The warhead of claim 1, further comprising a central fuze for controlling the firing of initiation charges inside and outside the warhead.

* * * * *